US007520096B2

(12) United States Patent
Hiraguri et al.

(10) Patent No.: US 7,520,096 B2
(45) Date of Patent: Apr. 21, 2009

(54) SOUND INSULATING FLOOR STRUCTURE

(75) Inventors: Hiroaki Hiraguri, Komagane (JP); Kazuharu Horiuchi, Kamiina-gun (JP)

(73) Assignee: Taisei Electronic Industries Co., Ltd. (JP)

( * ) Notice: Subject to any disclaimer, the term of this patent is extended or adjusted under 35 U.S.C. 154(b) by 772 days.

(21) Appl. No.: 10/770,428

(22) Filed: Feb. 4, 2004

(65) Prior Publication Data

US 2004/0154240 A1 Aug. 12, 2004

(30) Foreign Application Priority Data

Feb. 6, 2003 (JP) ..... 2003-29423

(51) Int. Cl.
*E04B 5/00* (2006.01)
*E04B 5/48* (2006.01)

(52) U.S. Cl. ..... 52/263; 52/126.1

(58) Field of Classification Search ..... 52/263, 52/126.2, 126.7, 220.5, 220.3; 174/48, 49
See application file for complete search history.

(56) References Cited

U.S. PATENT DOCUMENTS

| | | | | |
|---|---|---|---|---|
| 3,318,057 | A * | 5/1967 | Norsworthy | 52/126.6 |
| 3,470,663 | A * | 10/1969 | Tate | 52/126.6 |
| 3,689,017 | A * | 9/1972 | Harvey | 248/354.3 |
| 3,811,237 | A * | 5/1974 | Bettinger | 52/126.6 |
| 3,982,364 | A * | 9/1976 | Horvath | 52/126.6 |
| 4,085,557 | A * | 4/1978 | Tharp | 52/263 |
| 4,295,319 | A * | 10/1981 | Griffin | 52/783.1 |
| 4,942,708 | A * | 7/1990 | Krumholz et al. | 52/263 |
| 5,048,242 | A * | 9/1991 | Cline | 52/126.6 |
| 5,389,737 | A * | 2/1995 | Kobayashi et al. | 174/483 |
| 5,398,466 | A * | 3/1995 | Oyama et al. | 52/126.6 |
| 5,501,754 | A | 3/1996 | Hiraguri | |
| 5,791,096 | A * | 8/1998 | Chen | 52/126.6 |
| 6,101,768 | A * | 8/2000 | Springstead et al. | 52/126.6 |
| 6,115,975 | A * | 9/2000 | Abdollahi | 52/179 |
| 6,332,292 | B1 * | 12/2001 | Buzon | 52/126.6 |

FOREIGN PATENT DOCUMENTS

| | | | |
|---|---|---|---|
| JP | 02269254 | A * | 11/1990 |
| JP | 03-017348 | | 1/1991 |
| JP | 04-085453 | | 3/1992 |
| JP | 4-173104 | | 6/1992 |

(Continued)

OTHER PUBLICATIONS

Chinese Office Action; Application No. 200410028315.3; Dated: Feb. 5, 2004.

*Primary Examiner*—Jeanette Chapman
(74) *Attorney, Agent, or Firm*—Rader Fishman & Grauer PLLC; Ronald P. Kananen

(57) ABSTRACT

A sound insulating floor structure comprises an underlying floor layer of a raised floor constructed by supporting a plurality of underlying floor panels at a predetermined height by means of a group of supporting legs installed on a foundation floor via elastic pedestals attached to the lower ends of the supporting legs, floor covering materials laid over the underlying floor layer, and intermediate materials laid between the underlying floor layer and the floor covering materials. The intermediate material is a hardboard or a high density fiberboard having the flexural strength of 35-50 [N/mm$^2$], Young's modulus in flexure of 4,000-5,000 [N/mm$^2$] and the density of 0.8-1.2 [g/cm$^3$].

7 Claims, 9 Drawing Sheets

FOREIGN PATENT DOCUMENTS

| | | | | |
|---|---|---|---|---|
| JP | 4-116537 | | | 10/1992 |
| JP | 07-090951 | | | 4/1995 |
| JP | 7279368 | | * | 10/1995 |
| JP | 10037434 | A | * | 2/1998 |
| JP | 10-259658 | | | 9/1998 |
| JP | 11166309 | A | * | 6/1999 |
| JP | 2001263420 | A | * | 9/2001 |
| JP | 2002-081196 | | | 3/2002 |
| JP | 2005220549 | A | * | 8/2005 |
| JP | 2005336382 | A | * | 12/2005 |
| KR | 2004095136 | A | * | 11/2004 |

* cited by examiner

SOUND INSULATING FLOOR STRUCTURE

BACKGROUND OF THE INVENTION

1. Field of the Invention

This invention relates to a sound insulating floor structure of a raised floor, and more particularly to a sound insulating floor structure constructed by a dry-floor construction method so as to form a space between the raised floor and the surface of the existing foundation floor or sub-floor in a variety of buildings such as apartment houses, mansions and the like.

2. Description of the Prior Art

A floor structure comprising an underlying floor layer of a raised floor constructed by supporting a plurality of underlying floor panels at a predetermined height by means of a group of supporting legs installed on a foundation floor or sub-floor via elastic pedestals attached to the lower ends of the supporting legs, intermediate materials laid on the underlying floor layer thus assembled, and floor covering materials laid on the intermediate materials is called a raised dry-floor structure and widely adopted in apartment houses, gymnastics facilities, etc. Such a raised dry-floor structure is devised so that the impact applied to the raised floor may be buffered by the elastic pedestals made of a cushion rubber etc. attached to the lower ends of the supporting legs.

For example, Japanese Patent Application, KOKAI (Early Publication) No. (hereinafter referred to briefly as "JP") 4-85453 proposes to place on a foundation floor or sub-floor such as concrete slab side by side panel units each comprised of an underlying floor panel and height-adjustable supporting legs attached to the four corners of the panel and provided with elastic pedestals at the lower ends thereof, lay intermediate materials on the panel units, and then lay floor covering materials thereon. JP 3-17348 and Japanese Utility Model Application, KOKAI (Early Publication) No. 4-116537 disclose a method of assembling a raised dry-floor which uses in combination a group of unit supporting legs each comprised of a rod-shaped leg member provided with a rubber pedestal at its lower end rotatably and a support member mounted on the upper end of the rod-shaped leg member in such a manner that it may be moved up and down to adjust the level thereof, and a group of rectangular and/or square underlying floor panels each having a predetermined dimension. This method comprises disposing the unit supporting legs on the surface of a foundation floor at prescribed pitches, and disposing underlying floor panels while leaving predetermined gaps therebetween such that they are supported by the above-mentioned unit supporting legs at positions along their marginal portions.

The floor structure of such configuration is intended to provide a floor surface which will give good feelings of walking or motion owing to the function of the elastic pedestals attached to the lower ends of the supporting legs and which will buffer the impact against the floor surface by the elasticity of the elastic pedestals.

In recent years, however, the propagation of the indoor noises, especially the floor impact noises, to the downstairs poses a serious problem. Since the propagation of the floor impact noises is done not only through the supporting legs but also through the space under the floor and the wall as well, sufficient sound insulation is not acquired only by the elastic pedestals attached to the lower ends of the supporting legs.

Recently, the wood finishing, such as flooring finishing, is widely adopted particularly in the apartment houses instead of using the conventional carpet etc. as a floor covering material. When the wood flooring material is used, however, it will cause aggravation of housing environment because the floor impact noises tend to be directly propagated as a solid-state sound to the foundation floor, as compared with soft floor covering material such as a carpet, and bring loud noises downstairs.

In the case of the flooring to be directly applied, it should have a soft surface in order to improve the sound insulation properties only by the flooring (if it is not soft, the sound insulation properties cannot be improved). However, the soft surface will in turn cause the problems in the floor impact noise insulating properties and in the feel of walking.

Although the sound insulating raised dry-floor has the floor impact noise insulating properties given to the floor frame structure and has been usually finished so as to give a colored floor (flooring), much measures and cost are required to improve the floor impact noise insulating properties. As the measures for coping with the above noise problems, a vibration-damping and sound-insulating sheet, for example, is generally used. As the vibration-damping and sound-insulating sheet, generally a vibration-damping and sound-insulating sheet obtained by forming a sheet from a mixture of an organic binder, such as a synthetic resin or rubber, and a metal powder and adhering a fibrous layer, such as a felt, onto the surface of the sheet is used (see JP 7-90951).

However, it is difficult to fully reduce propagation of the floor impact noises only with such a vibration-damping and sound-insulating sheet. That is to say, the floor impact noises include the light floor impact noise generated by the hard and light impact and represented by the drop sound of tableware, the drag sound of a desk or a chair, the walk sound with slippers, or the like (rapping and tapping sounds) and the heavy floor impact noise generated by the soft and heavy impact such as hopping, jumping down, running about, etc. of people (sounds like a rub-a-dub and a thud). Although the conventional vibration-damping and sound-insulating sheet mentioned above is effective in suppressing the heavy floor impact noise, it is not so effective to the light floor impact noise. To solve such problems, the applicant has also developed a vibration-damping and sound-insulating sheet consisting of an asphalt sheet or a rubber-asphalt sheet containing a metal powder (see JP10-259658). This sheet is effective in improving the sound insulating properties not only for the heavy floor impact noise but also for the light floor impact noise. When such a vibration-damping and sound-insulating sheet is used, however, there is another disadvantage in that the cost for construction of a raised floor will increase. Moreover, a decrease of the durability due to the deterioration of the rubber-based material with long-term use thereof and the other problem should also be considered.

SUMMARY OF THE INVENTION

It is, therefore, an object of the present invention to provide a sound insulating raised dry-floor which uses in skillful combination the features and properties of the underlying structure of a sound insulating raised dry-floor and the features and properties of the flooring finishing to be directly applied, gives a better feeling of walking, and excels in durability and floor impact noise insulating properties without using a vibration-damping and sound-insulating sheet, even when a hard floor covering material, such as a wood-based flooring is used.

A further object of the present invention is to provide a sound insulating floor structure which excels in floor impact noise insulating properties and can be constructed with good workability and a sufficient laying speed at a relatively low cost.

SUMMARY OF THE INVENTION

To accomplish the objects described above, the present invention provides a sound insulating floor structure comprising an underlying floor layer of a raised floor constructed by supporting a plurality of underlying floor panels at a predetermined height by means of a group of supporting legs installed on a foundation floor via elastic pedestals attached to the lower ends of the supporting legs, floor covering materials laid over the underlying floor layer, and intermediate materials laid between the underlying floor layer and the floor covering materials, characterized in that the intermediate material is a hardboard or a high density fiberboard having the flexural strength of 35-50 [N/mm$^2$], Young's modulus in flexure of 4,000-5,000 [N/mm$^2$] and the density of 0.8-1.2 [g/cm$^3$].

In a preferred embodiment of the present invention, the supporting leg mentioned above is a unit supporting leg comprising an elastic pedestal, a hollow supporting bolt rotatably disposed on the elastic pedestal mentioned above in the erected state, and a support plate mounted on the hollow supporting bolt in such a manner that it can be moved up and down to adjust the height thereof through the medium of a level adjusting nut screwed onto the upper end of the hollow supporting bolt mentioned above, wherein the elastic pedestal has a bore portion for accommodating the lower end of the hollow supporting bolt, at least one groove formed in the underside thereof, and at least one hole intercommunicating the above-mentioned bore portion to the above-mentioned groove. More preferably, the hollow supporting bolt mentioned above has a bulge portion enlarged in the lateral direction and formed in a predetermined position of a portion thereof to be inserted in the bore portion of the elastic pedestal. On the other hand, the elastic pedestal has a concaved portion formed in the inside circumferential surface of the bore portion thereof for accommodating the bulge portion of the above-mentioned hollow supporting bolt and at least one groove connected with the intercommunicating hole mentioned above and formed so as to extend from the bottom surface of the bore portion to the side of the pedestal. Furthermore, it is desirable that the above-mentioned elastic pedestal should have at least three projections in the underside contacting with a foundation floor. It is also desirable that the support plate should have an adhesive sheet for temporary fixing and an adhesive agent flow portion formed on the upper surface thereof.

In the sound-insulating floor structure of the present invention, since the hardboard or high-density fiberboard having the flexural strength, Young's modulus in flexure and the density respectively falling in the specific ranges mentioned above is laid between the underlying floor panel and the floor covering material, even when a hard floor covering material such as a wood-based flooring is used, it is possible to skillfully combine the features and properties of the underlying structure of the sound insulating raised dry-floor and the features and properties of the flooring finishing to be directly applied. As a result, the sound insulating floor structure which gives a better feeling of walking and excels in durability and floor impact noise insulating properties, without using a vibration-damping and sound-insulating sheet, can be constructed with good workability and a sufficient laying speed at a relatively low cost.

Further, by adopting in combination:

the use of the unit supporting leg provided with the elastic pedestal having a plurality of (at least three) projections, preferably semispherical projections, formed in the underside contacting with a foundation floor, particularly the elastic pedestal having at least one groove formed in the underside thereof and at least one hole intercommunicating the center bore portion of the pedestal mentioned above to the groove mentioned above; and the laying of the hardboard or high-density fiberboard having the above-mentioned specific physical properties between the underlying floor panel and the floor covering material, it is possible to compensate the insufficiency of the individual constructional features, thereby making possible to reduce the floor impact noises effectively, to effectively prevent propagation of the floor impact noises or other noises to downstairs, to improve a sound-damping performance, and to increase a laying speed remarkably.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

Figure 1:
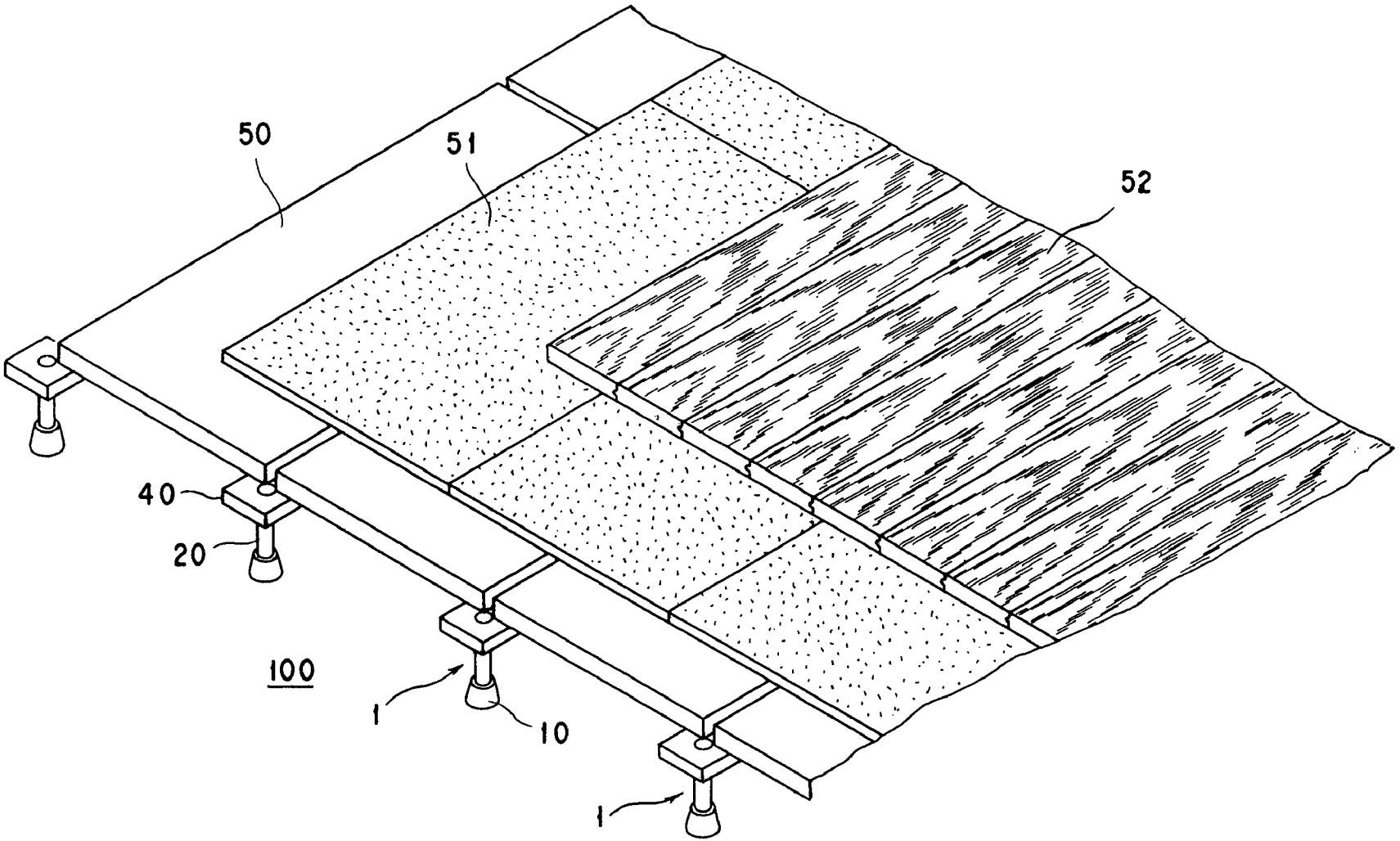
FIG. 1 is a fragmentary perspective view schematically illustrating an embodiment of the sound insulating floor structure according to the present invention.

The present inventors have found that in a floor structure comprising an underlying floor layer of a raised floor constructed by supporting a plurality of underlying floor panels at a predetermined height by means of a group of supporting legs installed on a foundation floor via elastic pedestals attached to the lower ends of the supporting legs and floor covering materials laid over the underlying floor layer, when a hardboard or a high density fiberboard having the flexural strength of 35-50 [N/mm$^2$], Young's modulus in flexure of 4,000-5,000 [N/mm$^2$] and the density of 0.8-1.2 [g/cm$^3$] is laid between the underlying floor panel and the floor covering material, there is obtained the floor impact noise insulating properties equivalent to or superior to those obtained by using a vibration-damping and sound-insulating sheet, unexpectedly.

A hardboard is prepared by adding a few chemicals, such as a resin and paraffin, to vegetable fibers, such as pulp and kenaf, for the purpose of increasing the strength and resistance to water, completing paper-making to obtain a fiberboard, then forming it under high temperature and high pressure, and further subjecting the formed fiberboard to aging under application of heat and humidity to increase the physical properties. On the other hand, the manufacture of a high-density fiberboard (HDF) differs from that of a hardboard in the addition of a small amount of an adhesive (a binder, a phenol resin, etc.) at the time of manufacture. Although the basic physical properties of HDF are not different from those of the hardboard, the surface density is higher than the internal density. Therefore, the water resistance of HDF is higher than that of the hardboard. The expansion coefficient in thickness due to water absorption of the hardboard is about 20%, whereas that of HDF is very low, 2-3%. Although JIS (Japanese Industrial Standard) defines that among the fiberboards obtained by forming mainly vegetable fibers of wood etc., those having the density of not less than 0.35 g/cm$^3$ and less than 0.80 g/cm$^3$ are classified into a fiberboard, hardboard or a high-density fiberboard has the density higher than that range. As for the hardboard and the high-density fiberboard, those having a wide range of physical properties are known in the art. However, among other hardboards and high-density fiberboards, those having the flexural strength of 35-50 [N/mm$^2$] and Young's modulus in flexure of 4,000-5,000 [N/mm$^2$] should be used in the present invention. It was surprising knowledge that by the use of the hardboard and the high-density fiberboard having the above specific properties, the sound-insulating raised dry-floor which excels in floor impact noise insulating properties can be constructed without using a vibration-damping and sound-insulating sheet. Moreover, since such a hardboard and a high-density fiberboard are hard, they give the floor structure a better feelings of walking. Since their water absorption is low (generally not more than 35%, preferably not more than 25%), they also excels in durability and will scarcely cause the problem of degradation with long-term use, unlike a rubber-based material heretofore used in a vibration-damping and sound-insulating sheet.

When the hardboard or high-density fiberboard having the flexural strength of 35-5.0 [N/mm$^2$] the Young's modulus in flexure of 4,000-5,000 [N/mm$^2$] and the density of 0.8-1.2. [g/cm$^3$] is laid between an underlying floor panel and a floor covering material, why can the sound-insulating raised dry-floor excelling in floor impact noise insulating properties be constructed without using a vibration-damping and sound-insulating sheet? Although, it cannot say that the theoretical elucidation about such a phenomenon is fully made, it will be conceivable as follows. A material usually used as an underlying floor panel, for example, a particle board has such physical properties as the flexural strength falling in the range of 8-30 (N/mm$^2$), the Young's modulus in flexure falling in the range of 2,000-4,000 (N/mm$^2$), and the density falling in the range of 0.4-0.9 (g/cm$^3$). Since it is inferior in strength, it tends to easily deflect. Further, it has the problem of being easy to generate creaking or vibration sounds because it is easy to vibrate when someone walks on the floor. Therefore, it is considered that by laying the hardboard or high-density fiberboard of the above-mentioned physical properties in combination with the particle board of such physical properties, vibration of the particle board as the underlying material is suppressed and the deflection of a floor is decreased, and, as a result, the sound-damping properties are improved.

In a preferred embodiment of the present invention, as one measure for improving the sound insulating properties of the floor structure, three or more, preferably four or more projections are formed in the underside of the elastic pedestal to be attached to the lower end of the supporting leg. Although the elastic pedestal is made of a material of low impact resilience, such as rubber, the effects of lowering an floor impact noise level, especially the effect of lowering a heavy floor impact noise level are obtained by forming projections in the underside thereof, thereby decreasing the area contacting the foundation floor and distributing the load to be applied thereto. As the shape of the projection, any configuration, such as a hemispherical shape, a cylindrical shape, a ring-like shape, and concentric rings having a center aligned with the axis of a supporting leg may be considered. It is also possible to make the respective heights of projections irregular so as to have different heights. However, the hemispherical projections, preferably of the same height, are advantageous from the viewpoints of that they can support the pedestal stably, the area contacting the foundation floor is small, and moderate elasticity (sinkage) can be secured. Incidentally, it is required not to form a projection on the position aligned with the axis of the supporting leg through which a load is delivered to the elastic pedestal. This is because if a projection is formed on the underside of the elastic pedestal at the position aligned with the axis of the supporting leg, the resultant reduction of the floor impact noise level will be almost same as that obtained with an elastic pedestal having a flat underside.

The measure of forming a plurality of projections on the underside of the elastic pedestal is effective in either case when the supporting leg is provided with a hollow supporting bolt or a solid supporting bolt. In the effect of preventing propagation of floor impact noises, however, the hollow supporting bolt is excellent as compared with the solid supporting bolt.

Accordingly, it is possible to improve a sound-damping performance and increase a laying speed remarkably by adopting in combination: the use of a unit supporting leg comprising an elastic pedestal having a bore portion for accommodating the lower end of a hollow supporting bolt, a hollow supporting bolt rotatably disposed on the elastic pedestal mentioned above in the erected state, and a support plate mounted on the hollow supporting bolt in such a manner that it can be moved up and down to adjust the height thereof through the medium of a level adjusting nut screwed onto the upper end of the hollow supporting bolt mentioned above, wherein the elastic pedestal has at least three projections, preferably four or more projections formed in the underside thereof, particularly the elastic pedestal has at least one groove formed in the underside thereof and at least one hole intercommunicating the bore portion of the pedestal mentioned above to the groove mentioned above; and the laying of the hardboard or high-density fiberboard having the specific physical properties mentioned above between the underlying floor panel and the floor covering material.

Specifically, in one adhesive agent pouring process an adhesive agent flows into the gap between the underlying floor panel and the support plate of the unit supporting leg, and the gap between the level adjusting nut and the hollow supporting bolt and bond and fix them, and further flows down through the central through-hole of the hollow supporting bolt and the intercommunicating hole of the elastic pedestal, arrives at the groove formed in the underside of the pedestal, and bonds and fixes the elastic pedestal to the foundation floor. Therefore, by one adhesive agent pouring process, the bonding and fixing of the underlying floor panel to the support plate, the bonding and fixing of the level adjusting nut to the hollow supporting bolt, the bonding and fixing of the hollow supporting bolt to the elastic pedestal, and the bonding and fixing of the elastic pedestal to the foundation floor can be performed simultaneously, and the workability of adhesive agent pouring is markedly improved.

When one or a plurality of grooves are formed in the underside of the elastic pedestal, an adhesive agent flows into the gap between the underside of the pedestal and the surface of the foundation floor more smoothly and uniformly. Further, since the groove formed in the underside of the elastic pedestal plays the role of a cushion, the impact added to the floor is eased and excellent noise-insulating and vibration-damping effects may be obtained.

Further, since one adhesive agent pouring process can simultaneously perform fixation of the underlying floor panel to the support plate of the unit supporting leg, and locking of the supporting bolt (fixing of the supporting bolt and the level adjusting nut). Consequently, there is no possibility that fixing of the underlying floor panel to the support plate may loosen, unlike the fixing only by nails, and the locking of the supporting bolt can also be simultaneously attained even if a walking vibration is repeatedly added to the underlying floor panel, and thus a squeak of floor can be prevented almost everlastingly.

Moreover, since what is necessary is just to pour an adhesive agent into the gap between adjoining underlying floor panels at the positions placed on the unit supporting legs after laying the underlying floor panels, rather than applying an adhesive agent to respective upper surfaces of the support plates of the unit supporting legs, the workability is very high and such a problem that an adhesive agent adheres to an operator's hand and clothes, or the surroundings and contaminates them is also eased considerably.

Now, the present invention will be described more concretely with reference to embodiments shown in the attached drawings and experiments.

FIG. 1 shows an embodiment of the sound insulating floor structure of the present invention constructed by laying the underlying floor panels 50 as supported at a predetermined height level by the unit supporting legs 1 on the foundation floor 100, such as a concrete slab, then laying the hardboards or high-density fiberboards 51 of the above-mentioned physical properties thereon to form an underlying floor layer of a raised floor, and thereafter laying floorings 52 as a floor covering material on the formed underlying floor layer.

Figure 2:
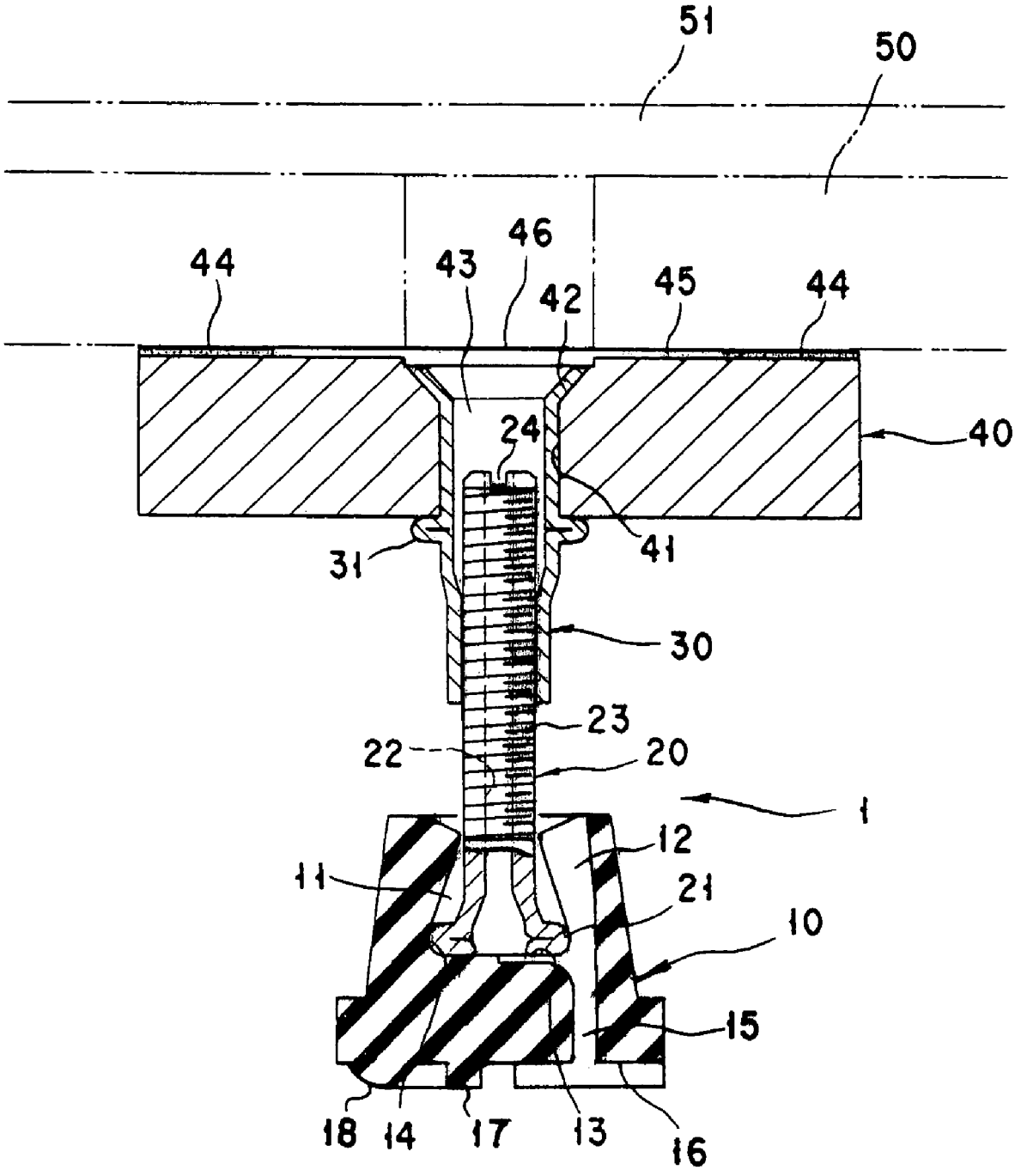
FIG. 2 is a cross-sectional view schematically illustrating an embodiment of a unit supporting leg for use in the sound insulating floor structure according to the present invention.
Figure 3:
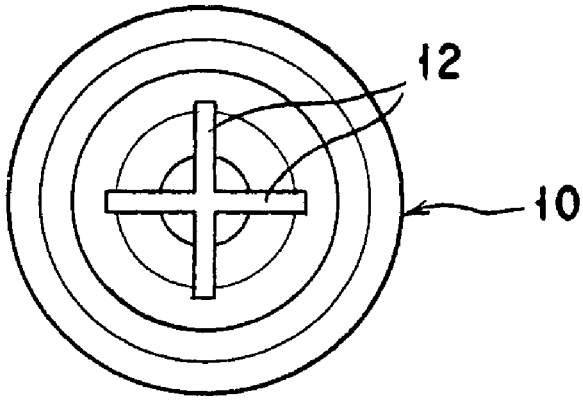
FIG. 3 is a plan view of an elastic pedestal used in the unit supporting leg shown in FIG. 2.
Figure 4:
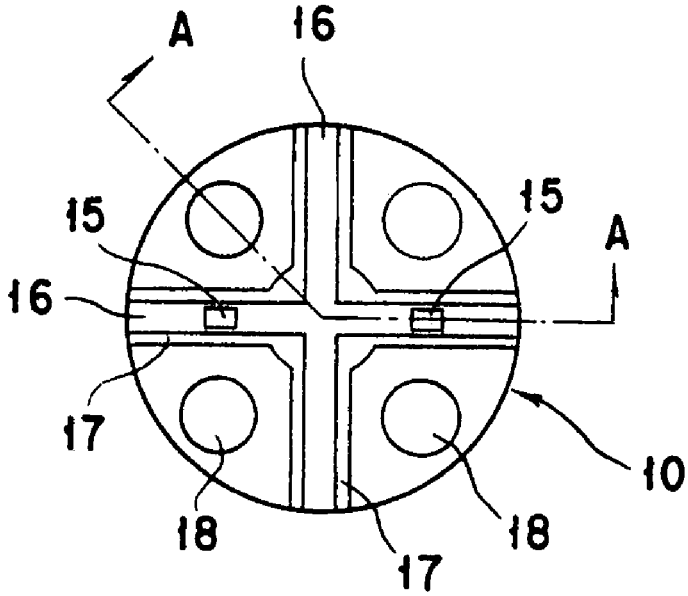
FIG. 4 is a bottom view of the elastic pedestal used in the unit supporting leg shown in FIG. 2.

FIG. 2 through FIG. 4 show a preferred embodiment of a unit supporting leg using a hollow supporting bolt.

The unit supporting leg 1 of this embodiment is comprised of leg members consisting of a vibration-proof elastic pedestal 10 made of an elastic material, such as rubber, and a hollow supporting bolt 20 rotatably disposed on the pedestal 10 mentioned above in the erected state, and support members consisting of a level adjusting nut 30 which has an annular support portion 31 laterally protruded from approximately a center section of the outer periphery thereof, and a support plate 40 having at a center an insertion hole (through-hole) 41 to which the upper part of the level adjusting nut 30 mentioned above is fitted. Although the support plate 40 is formed in a square or rectangle, it may be arbitrarily formed into any shape.

In this unit supporting leg 1, a center bore 11 for the insertion of the lower end of the hollow supporting bolt 20 is formed in the upper center of the elastic pedestal 10 so as to have a depth of about half of the height thereof. The center bore 11 has in its inner peripheral surface an annular groove-like concave 14 for accommodating a lower end lobe 21 of the hollow supporting bolt bulging in the lateral direction thereof. Moreover, in the inner peripheral surface of the center bore 11, cross-like grooves 12 are formed so as to extend from a base (seating portion) 13 to the side wall, as clearly shown in FIG. 2 and FIG. 3. A plurality (four in the case of the illustrated embodiment) of grooves 16 each having a substantially U-shaped section defined by ribs (ridges) 17 are formed in the underside of the elastic pedestal 10 so as to extend in the radial direction (in the shape of a cross) from the center to the outer peripheral surface. Furthermore, as clearly shown in FIG. 2 and FIG. 4, a pair of intercommunicating holes 15 each passing through from the groove 12 of the center bore 11 mentioned above to the groove 16 formed in the underside of the elastic pedestal mentioned above are formed substantially vertically. Although the formed intercommunicating holes 15 are two, three or four or more of the intercommunicating holes may be formed in harmony with the cross-like grooves 12 mentioned above. Alternatively, one intercommunicating hole may be formed depending on the fluidity of an adhesive agent to be used.

Furthermore, four projections 18 of a substantially semi-spherical shape are symmetrically formed on the underside of the elastic pedestal 1 at the positions each between the grooves 16 mentioned above. Incidentally, FIG. 2 shows the cross section viewed from the A-A line shown in FIG. 4. The formation of such hemispherical projections 18 and grooves 16 projected in the shape of letter "U" is effective in decreasing the area contacting with a foundation floor, dispersing the load received via the supporting bolt, and exhibiting moderate elasticity (sinkage). As a result, the effects of decreasing floor impact noises, especially heavy floor impact noises, and effective prevention of the propagation of floor impact noises to the downstairs, particularly in apartment houses, are acquired. The height of the hemispherical projection 18 and the height (depth) of the groove 16 are preferred to be about 2-4 mm respectively, and the same height is more desirable. If the height of the projection is too low, the floor impact noise reduction effect is weak. Conversely, if the height is too high, the sinkage of a floor becomes large, which will cause such problems that the stable feelings of walking will not be attained or a step-like difference in level of the floor surface will be easily produced.

On the other hand, the hollow supporting bolt 20 is manufactured from a comparatively short hollow pipe having a central through-hole 22, and its lower end to be inserted into the center bore 11 of the elastic pedestal 10 is provided with an annular lobe 21 which bulges in the lateral direction and is formed by buckling. A threaded portion 23 is formed in the outer peripheral surface of the upper part of the hollow supporting bolt 20 over a predetermined distance from the upper end, and a groove-like engagement portion 24 (a minus groove in the illustrated embodiment, but which may be a plus groove or a polygonal concave) for the insertion of a leading end of a turning tool, such as a driver and an electric driver, therein is further formed in the upper end face of the hollow supporting bolt 20.

By fitting the lower end of the hollow supporting bolt 20 in the center bore 11 of the elastic pedestal 10 mentioned above, the hollow supporting bolt 20 will be rotatably installed on the elastic pedestal 10 in the erected state such that the lower end of the hollow supporting bolt is supported by the base (seating portion) 13 of the center bore 11 of the elastic pedestal 10. Since the lobe 21 engages with the concave 14 of the elastic pedestal 10, the detachment of the hollow supporting bolt 20 from the elastic pedestal 10 is prevented during a raised floor construction.

The upper part of the insertion hole 41 of the support plate 40 manufactured from a particle board, a plywood laminate, a wood fiberboard, etc. is beveled and enlarged. The level adjusting nut 30 mentioned above is firmly attached to the support plate 40 by fitting into the insertion hole 41 of this support plate 40, subsequently enlarging and partially embedding the upper part thereof in the beveled portion 42 of the insertion hole 41 of the support plate. Accordingly, an adhesives agent reservoir 43 is formed in the upper part of the level adjusting nut 30.

Incidentally, the adhesive agent reservoir may be formed by enlarging the upper part of the level adjusting nut itself or by beveling the upper part of the insertion hole of the support plate, into which the upper part of the level adjusting nut is fitted, to form an enlarged portion. This enlarged portion may be used as an adhesive agent reservoir.

The upper part of the threaded portion 23 of the hollow supporting bolt 20 is screwed into the level adjusting nut 30 thus fitted in the insertion hole 41 of the support plate 40 so as to form the unit supporting leg 1 assembled as shown in FIG. 2.

As shown in FIG. 2, a double-sided adhesive sheet 44 is attached to the upper surface of the support plate 40 of the above-mentioned unit supporting leg 1. When the unit supporting leg is used, a release sheet (not shown) which has covered the double-sided adhesive sheet 44 in advance is peeled off. Alternatively, an adhesive layer may be directly applied to the upper surface of the support plate 40 and a releasing paper may be laminated thereon for convenience of storage, transportation, etc.

Upon use of the unit supporting leg 1 assembled as mentioned above, by fitting a leading end of a turning tool such as a driver or the like, in the groove-like engagement portion 24 formed in the upper end face of the hollow supporting bolt 20 and turning the tool so as to turn the hollow supporting bolt, the level adjusting nut 30 and the support plate 40 in which the nut 30 is fitted are moved up or down so that the level of the floor surface of the underlying floor (underlying floor panel 50) to be supported by the support plate 40 can be adjusted.

Figure 5:
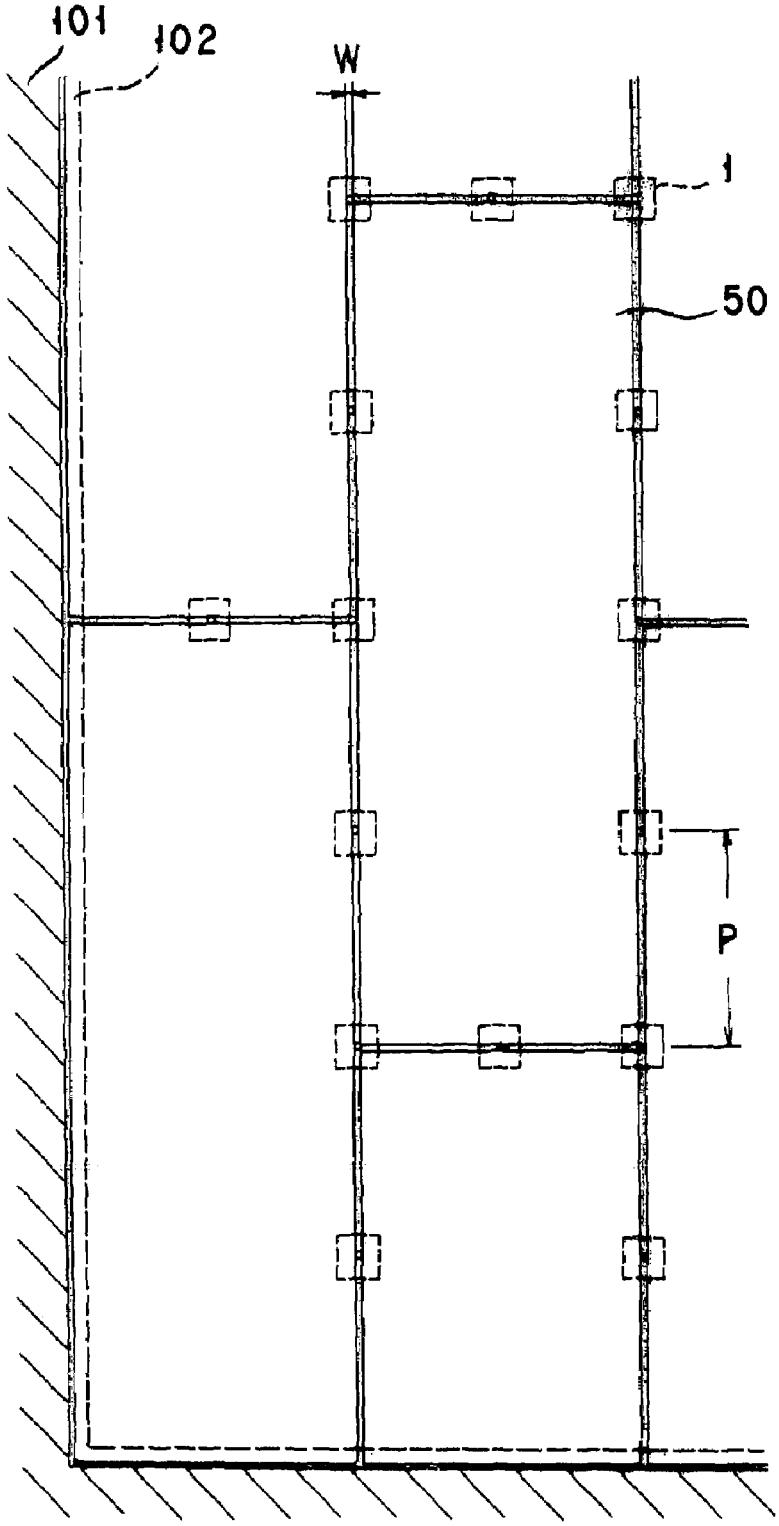
FIG. 5 is a fragmentary plan view schematically illustrating an example of the layout of underlying floor panels assembled by using the unit supporting legs shown in FIG. 2.

FIG. 5 shows an example of an arrangement or layout of underlying floor panels assembled in position. When the underlying floor layer of a raised floor is constructed, the floor joists 102 (or floor joist units) of such structure as comprising a joist member having one or two parallel through-holes formed therein, one or two supporting bolts each screwed into the supporting nut fitted in the through-hole mentioned above in such a manner that it can be moved up and down to adjust the height of the joist member, and one or two elastic pedestals each rotatably attached to the lower end of the supporting bolt) are attached to each of walls or partitions 101 of a room at a predetermined, fixed height. Thereafter, the unit supporting legs 1 are disposed on a foundation floor 100 at predetermined pitches P corresponding to the shape of the underlying floor panel. At this time, the underside of the elastic pedestal 10 of the unit supporting leg 1 may be fixed to the surface of a foundation floor 100 through the medium of a double-sided adhesive sheet or an adhesive agent. Then, the underlying floor panel 50 manufactured from a particle board, a plywood laminate, etc. is laid in such a manner that one side of the underlying floor panel 50 is placed on the floor joist 102 (or floor joist unit). The other marginal portion of the underlying floor panel 50 which is not placed on the floor joist 102 (or floor joist unit) is mounted on the unit supporting legs 1 disposed on the foundation floor 100 at predetermined pitches. The underlying floor panel 50 is attached to the unit supporting legs 1 through the intermediary of the adhesive sheets 44 affixed onto the upper surfaces of the support plates 40 of the latter. Upon laying the underlying floor panels, each underlying floor panel is provisionally fixed by pressing to the adhesive sheet 44. This process gives such advantages that the shift of the positions of the unit supporting legs or falling down thereof during the working can be prevented and thus the workability of construction of the raised floor is improved. The adhesive agent reservoirs 43 of the support plates 40 of the unit supporting legs 1 are kept in the state exposed between the edges of adjoining underlying floor panel 50. The level of the underlying floor panel 50 (or the levels of the upper surfaces of the support plates 40) is adjusted by turning the supporting bolt 20 from above by means of a driver or the like. An adjoining underlying floor panel is also mounted in the same manner on the unit supporting legs 1 already installed leaving a prescribed gap W between itself and the underlying floor panel already mounted so as to enable the levels of the underlying floor panels to be adjusted, and the other unit supporting legs 1 are installed in position and the adjoining underlying floor panel 50 is mounted thereon.

Such operations are repeatedly made for every underlying floor panels to lay them over a predetermined area. After the floor level is adjusted, an adhesive agent is poured into the adhesive agent reservoirs 43 of the unit supporting legs 1 exposed in the gap between adjoining underlying floor panels. As the adhesive agent to be used, although an epoxy-based, an urethane-based, or a vinyl acetate-based adhesive agent may be used, the epoxy-based and urethane-based adhesive agents are particularly suitable. The adhesive agent is put into a container, such as a tube and a pump, extruded through a convergent nozzle by applying a pressure thereto, and poured into the adhesive agent reservoir 43.

In the unit supporting leg 1 shown in FIG. 2 through FIG. 4 mentioned above, the central through-hole 22 of the hollow supporting bolt 20 intercommunicates with the center bore 11 of the elastic pedestal 10 and the center bore 11 of the elastic pedestal 10 intercommunicates with the groove 16 formed in the underside thereof. Accordingly, when an adhesive agent is poured into the adhesive agent reservoir 43 formed in the upper part of the level adjusting nut after the laying of the underlying floor panels and the adjustment of the floor level as described above, the adhesive agent penetrates into the screwed portion between the level adjusting nut 30 and the hollow supporting bolt 20 and further diffuses and penetrates into the gaps 45 (which functions as an adhesive agent flow portion) between the underlying floor panel 50 and the support plate 40 to bond and fix them. At the same time, the adhesive agent flows down through the central through-hole 22 of the hollow supporting bolt 20 and the intercommunicating hole 15 of the elastic pedestal, arrives at the contact surface between the hollow supporting bolt 20 and the elastic pedestal 10 and at the underside of the elastic pedestal 10, penetrates into the grooves formed in the underside of the elastic pedestal 10, and bonds and fixes the lower end of the hollow supporting bolt 20 and the elastic pedestal 10 as well as the elastic pedestal 10 and the foundation floor. Therefore, by one adhesive agent pouring process, the bonding and fixing of the level adjusting nut to the hollow supporting bolt, the bonding and fixing of the underlying floor panel to the support plate, the adhesion and fixing of the hollow supporting bolt to the elastic pedestal, and the bonding and fixing of the elastic pedestal to the foundation floor can be performed simultaneously, and the workability of adhesive agent pouring is markedly improved.

After the adhesive agent has solidified, if needed, the underlying floor panel 50 are nailed to the support plates 40, or further a comparatively rigid adhesive tape may be adhered to cover the gap W between the adjoining underlying floor panels or a long and slender embedding material may be fitted into the gap mentioned above, as occasion demands. Thereafter, the hardboards or high-density fiberboards 51 having the physical properties mentioned above are laid (if needed, fixed by nailing) to form the underlying floor layer as shown in FIG. 1. In accordance with the present invention, since the hardboard or high-density fiberboard 51 also functions as the intermediate material heretofore used in the conventional raised floor structure, the laying of the intermediate materials is not required. Incidentally, the laying of two or more layers of the hardboards or high-density fiberboards or the combined laying thereof may be adopted as occasion demands. As for the mode of arrangement of the underlying floor panels, they may be arranged in the zigzag configuration as shown in FIG. 5 or in parallel with each other.

After the underlying floor layer is assembled as described above, flooring 52 as a floor covering material are laid on the underlying floor layer to construct the sound insulating floor structure as shown in FIG. 1.

Incidentally, in the underlying floor structure assembled as described above, if needed for the purpose of further improving the floor impact noise insulating properties, a vibration-damping and sound-insulating sheet, such as a rubber-asphalt sheet, containing a metal powder like a cast iron powder or a sound insulating sheet obtained by laminating a polyester nonwoven fabric, a synthetic resin film or a metal foil on the surface and/or back surface of the sheet mentioned above may be laid on the underlying floor structure or, a sound absorbing material, such as a polyester-based, polypropylene-based, or pulp-based nonwoven fabric, preferably a polyester nonwoven fabric, especially a nonwoven fabric of polyester hollow fibers may be disposed in the almost whole region under the underlying floor panels except the supporting leg installation areas or in such a manner that the space under the floor may be divided into sections closed in the shape of a lattice. Further, the floor covering material is not limited to the above-mentioned flooring (sliced veneer laminated plywood) and any material, such as a wood decorative laminate, a synthetic resin cushion sheet, a mat, a carpet, and a tatami (a Japanese mat) may be used.

Figure 6:
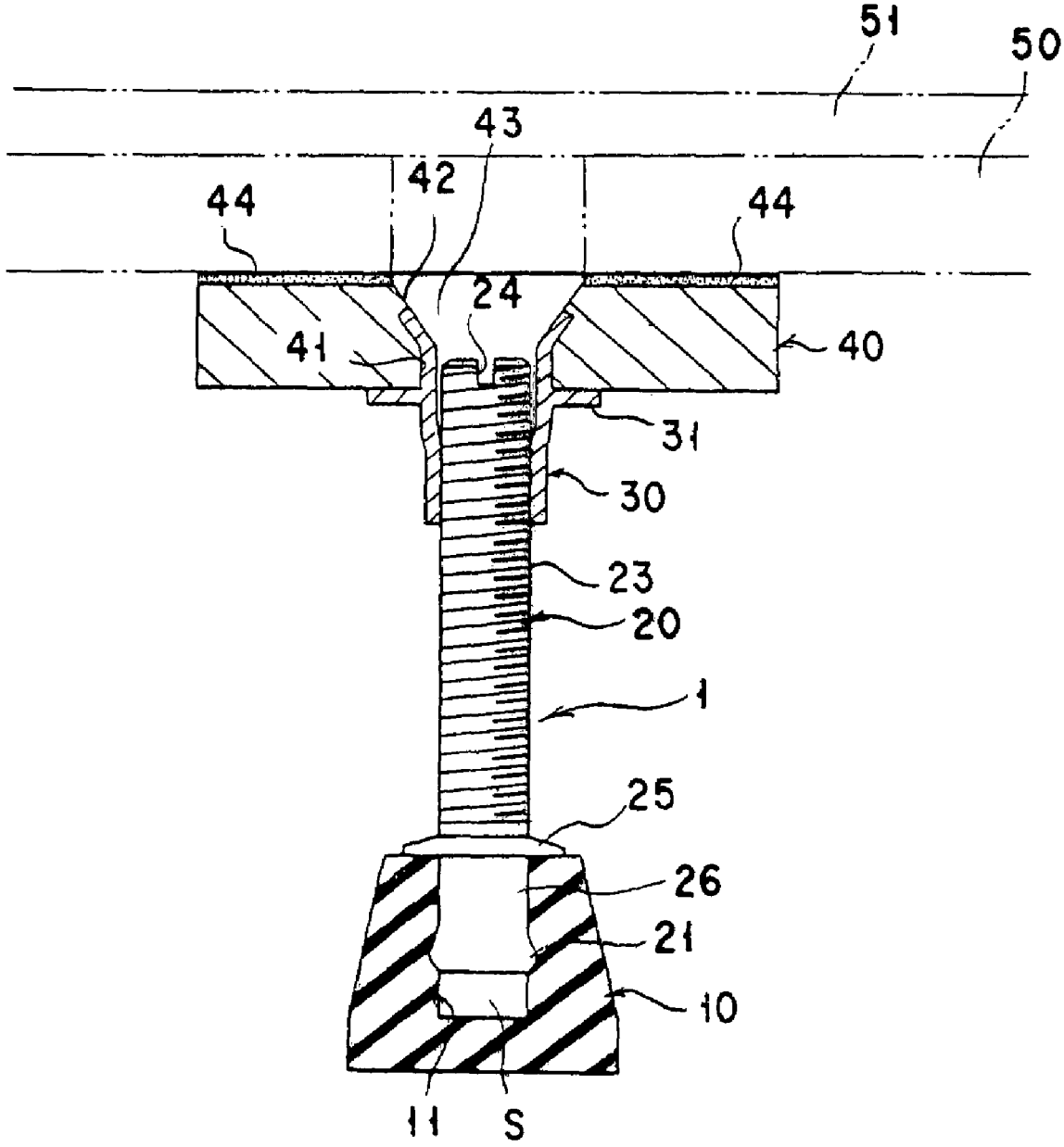
FIG. 6 is a cross-sectional view schematically illustrating another embodiment of a unit supporting leg for use in the sound insulating floor structure according to the present invention.

FIG. 6 shows another embodiment of the unit supporting leg 1 using a solid supporting bolt.

In the unit supporting leg 1 of this embodiment, the vibration-proof elastic pedestal 10 of an elastic material such as rubber is provided at the upper central portion thereof a blind center bore 11 for receiving the lower-end round rod portion 26 of the supporting bolt 20.

On the other hand, the metal solid supporting bolt 20 has an annular flange portion 25 which projects in the lateral direction and is integrally formed on the outer peripheral surface of the supporting bolt at a position separated from the lower end toward the upper part at a predetermined distance. Further, a threaded portion 23 is formed in the area above the flange portion, and the lower portion under the flange portion 25 is formed into the round rod portion of a circular cross section. The round rod portion 26 is provided at the lower end thereof with a lobe 21 which bulges in the lateral direction. Likewise the embodiment mentioned above, a groove-like engagement portion 24 for the insertion of a leading end of a turning tool therein is formed in the upper end face of the supporting bolt 20. By fitting the lower-end round rod portion 26 of the supporting bolt 20 in the center bore 11 of the elastic pedestal 10 mentioned above, the supporting bolt 20 will be rotatably installed on the elastic pedestal 10 in the erected state by utilizing the flange portion 25 as a support portion. Owing to the lobe 21 formed on the lower end of the round rod portion 26 of the supporting bolt 20, if the lower-end round rod portion 26 of the supporting bolt 20 is once fitted in the center bore 11 of the elastic pedestal 10, the detachment of the supporting bolt 20 from the elastic pedestal 10 is prevented. Incidentally, the length of lower-end round rod portion 26 is smaller than the depth of the center bore 11 of an elastic pedestal 10 so that an air chamber S is formed in the lower part. By establishing the air chamber S under the lower-end round rod portion 26, the air chamber S functions as an air cushion and the vibration damping effect is further improved. However, the unit supporting leg may not be provided with such an air chamber. It is desirable that a lubricant, such as grease, be applied to the inside of the center bore 11 of the elastic pedestal 10 to enable it to rotate the supporting bolt 20 smoothly and to close the air chamber S in the airtight state.

In case the unit supporting leg shown in FIG. 6 is used, after laying the underlying floor panels over a predetermined area in the same manner as mentioned above and adjusting the floor level, an adhesive agent is poured into the adhesive agent reservoirs 43 of the unit supporting legs 1 exposed in the gaps between the adjoining underlying floor panels to effect the fixation of the supporting bolt 20 to the level adjusting nut 30. Further, when a double-sided adhesive sheet 44 is attached to the upper surface of the support plate 40 of the unit supporting leg 1 only at both sides thereof or in the surrounding frame-like shape except the periphery of the adhesive agent reservoir 43, since a gap (which functions as the adhesive agent flow portion) is formed in this area between the underlying floor panel 50 and the support plate 40, the adhesive agent spreads and permeates into this gap. As a result, the bonding and fixing of the underlying floor panel to the support plate is also attained.

Thereafter, the hardboards or high-density fiberboards 51 having the physical properties mentioned above are laid to form the underlying floor layer and floorings 52 as a floor covering material are laid on the underlying floor layer. Incidentally, any floor covering materials other than the floorings may be used as explained hereinbefore.

Next, the effects of the present invention will be concretely described by showing the experiment as to the floor impact noise levels of various sound insulating floor structures.

Experiment:

In the following experiment, the method for measuring a floor impact noise level and the assessment thereof were carried out in the similar manner to those specified in JIS (Japanese Industrial Standard) A 1418 (a method for measuring the floor impact noise level in the site of a building) and JIS A 1419 (grade of sound insulation in a building). A measuring apparatus, a test method, and the assessment method are as follows.

Figure 7:
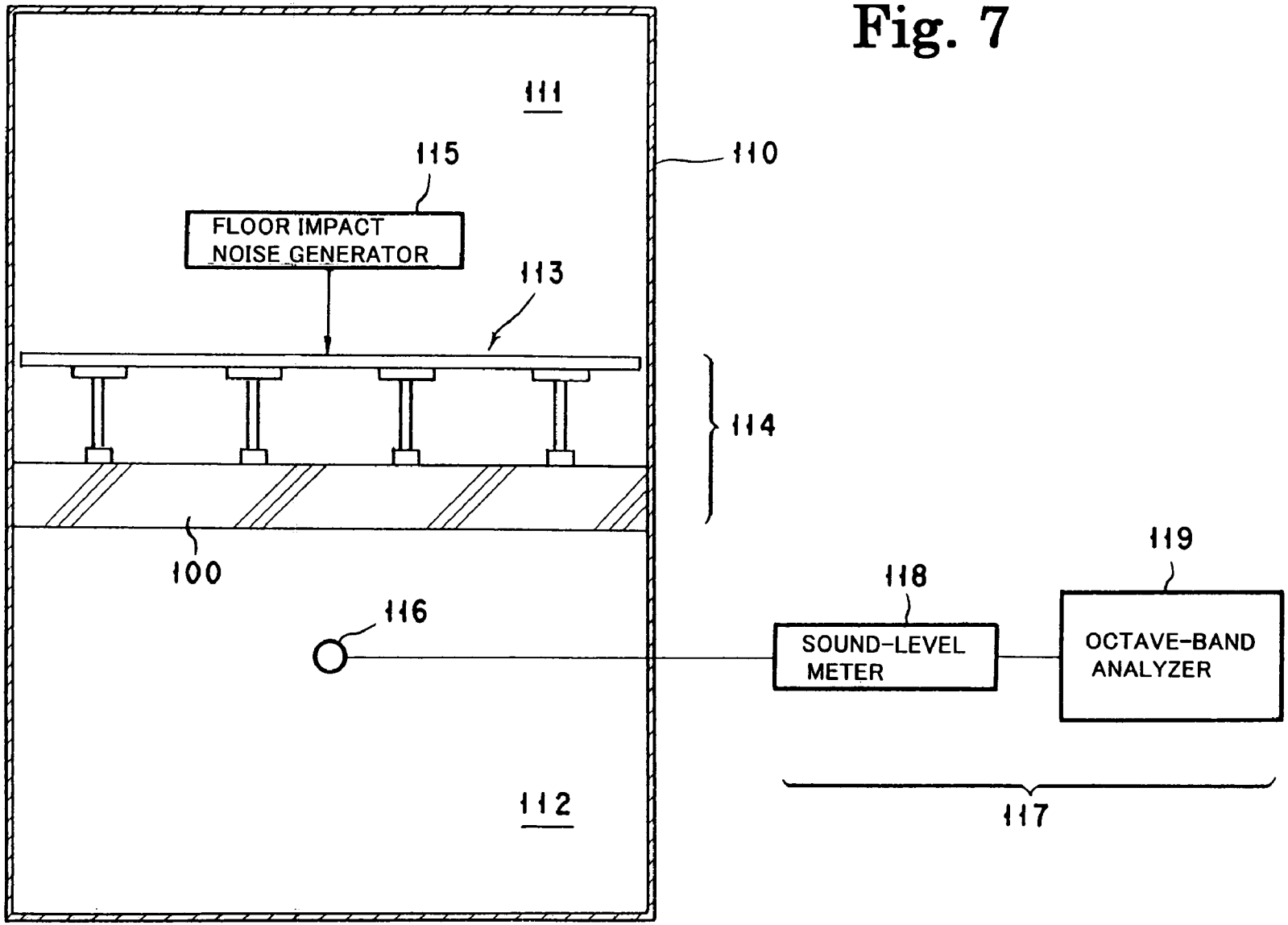
FIG. 7 is a diagram schematically illustrating a measuring apparatus used in the experiment.

Measuring Method:

As a laboratory, as shown in FIG. 7, an experiment building 110 divided into the upstairs sound source room 111 and the downstairs sound receiving room 112 by a foundation floor 100 consisting of a concrete slab (RC slab) with a thickness of 220 mm was used. In the sound source room 111, a raised floor 113 was constructed on the RC slab, as roughly shown in FIG. 8, to constitute a floor 114 to be measured consisting of the RC slab 1 and the raised floor 113.

By using two kinds of sound generators, a light floor impact noise generator (tapping machine) and a heavy floor impact noise generator (bang machine), as a floor impact noise generator 115, three positions were hit. The generated floor impact noises were collected with a microphone 116 installed in the downstairs sound receiving room 112 and received by a sound level meter 118 of sound receiving equipment 117. Their sound pressure levels were recorded by an octave analyzer 119 for every frequency band of 1/1 octave band. The frequency bands are 63 Hz, 125 Hz, 250 Hz, 500 Hz, 1,000 Hz (1 kHz), 2,000 Hz (2 kHz), and 4,000 Hz (4 kHz), which means that the sound is high in proportion as a numeric character becomes large.

(1) Amount of Improvement of Floor Impact Noise Level in Laboratory:

First, the concrete slab (RC slab surface) 100 in a sound source room 111 was directly hit by each floor impact noise generator (light and heavy) 115, and the floor impact noise level was measured in the sound receiving room 112.

Next, the raised floor 113 of the predetermined magnitude was constructed on the concrete slab (RC slab) 100 of the sound source room 111 which was directly hit. The floor impact noise was generated by the floor impact noise generator 115 in the same location directly hit as described above, and the floor impact noise level was measured in the sound receiving room 112. Incidentally, the floor impact noise level was represented by a mean value of the total values obtained by repeating the impact blow 3 times, respectively in three hitting points.

From the measured values obtained as described above, the amount of improvement of floor impact noise level, ΔL, in a laboratory was calculated by the following equation (1).

$$\Delta L = LO - Ln(\text{dB}) \quad (1)$$

LO: Floor impact noise level of RC slab itself (dB)

Ln: Floor impact noise level of RC slab with raised floor constructed thereon (dB)

(2) Presumption of Floor Impact Noise Level in a Site

The amount of improvement mentioned above is the absolute performance evaluation of the floor structure itself and differs from the assessment specified in JIS. Accordingly, in order to carry out assessment currently generally called "L value", the floor impact noise level in a site is presumed by the following equation (2).

$$L = Ls - \Delta L(\text{dB}) \quad (1)$$

Ls: Floor impact noise level of RC slab itself obtained in a site (dB)

ΔL: Amount of improvement of floor impact noise level in a laboratory (dB)

Therefore, this "L" is the floor impact noise level in a site as specified in JIS. By plotting this value in FIG. 2 of JIS A 1419, the L value specified in JIS will be presumed.

Figure 8:
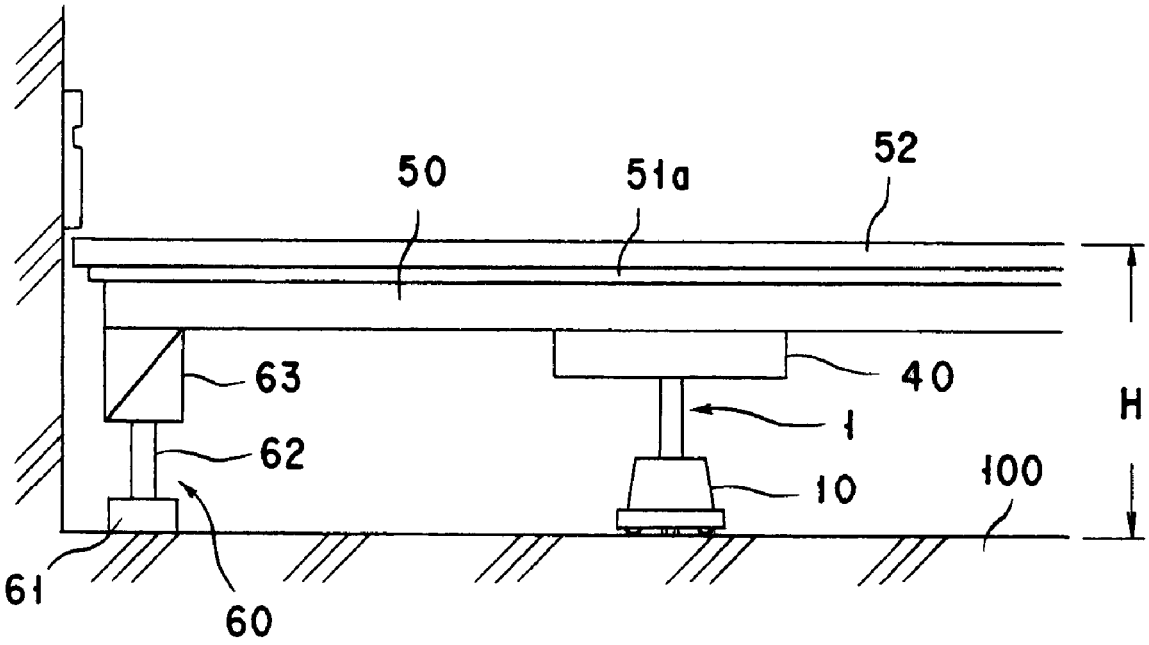
FIG. 8 is a partially sectioned side view schematically illustrating the sound insulating floor structure used in Experiment.

Test Floor:

The floor impact noise level was measured about the floor to be measured having the structure shown in FIG. 8.

The floor to be measured was constructed by placing the unit supporting legs 1 provided with the elastic pedestal 10 made of a vibration-proof rubber and having the structure shown in FIG. 2 to FIG. 4 on a concrete slab (RC slab) 100, setting the floor joist units 60 (which structure comprises a joist member 63 having two parallel through-holes formed therein, supporting bolts respectively screwed into the supporting nuts each fitted in the through-hole in such a manner that it can be moved up and down to adjust the height of the joist member, and elastic pedestals rotatably attached to the respective lower ends of the supporting bolts) along each of walls, laying the underlying floor panels 50 (made of particle board, 20 mm in thickness) on the support plates 40 of the unit supporting legs 1 via an adhesive layer formed thereon while leaving prescribed gaps therebetween in such a manner that they may be supported at their marginal portions by the unit supporting legs, laying thereon intermediate materials 51*a*; intermediate plywood laminates (12 mmm in thickness) in the case of the test floor 1, asphalt-based vibration-damping and sound-insulating sheets (6 mm in thickness) as described hereinbefore in the case of the test floor 2, and hardboards or high-density fiberboards (manufactured by Nichiha Co., Ltd., Nichiha Hardboard S35 type, 13 mm in thickness) as described hereinbefore in the case of the test floor 3, arranging finishing floorings 52 having the thickness of 12 mm (sliced veneer laminated plywood), and adjusting the floor level to the height, H; 132 mmm in the cases of the test floors 1 and 3 and 126 mm in the cases of the test floor 2. Incidentally, the joist member 63 of the joist unit 60, the support plate 40 of the unit supporting leg 1 and the underlying floor panel 50 were fixed by nailing, and the flooring 52, the intermediate material 51*a* and the underlying floor panel 50 were also fixed by nailing.

Figure 9:
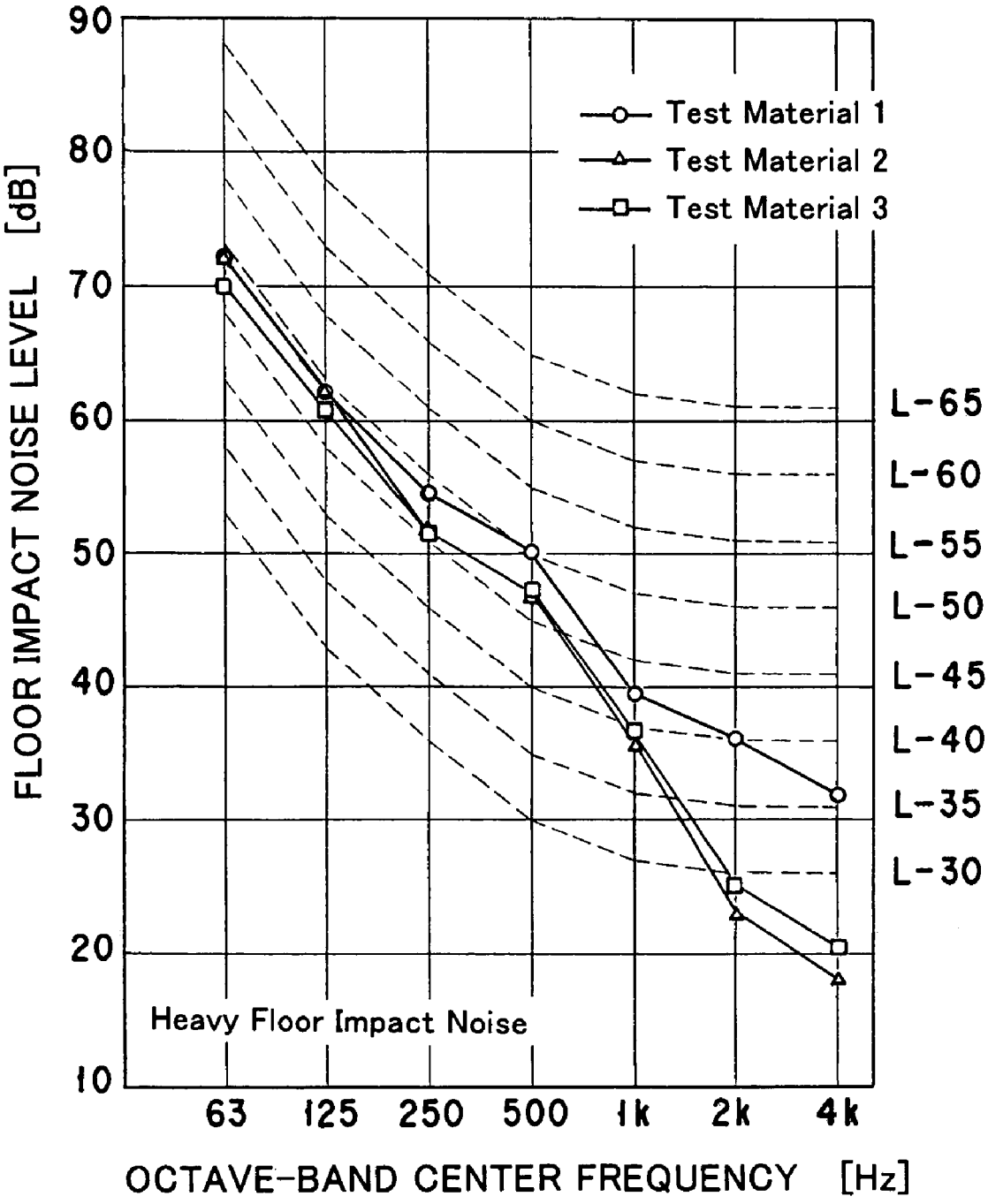
FIG. 9 is a graph showing the results of the heavy floor impact noise level measured in the experiment.

The measurement results of the heavy floor impact noise level are shown in Table 1 and FIG. 9. The measurement results of the light floor impact noise level are shown in Table 2 and FIG. 10.

TABLE 1

Heavy Floor Impact Noise Level (dB)

| | Test Floor | Octave-band Center Frequency 63 | 125 | 250 | 500 | 1000 | 2000 | 4000 | L |
|---|---|---|---|---|---|---|---|---|---|
| 1 | Intermediate Plywood Laminate | 72 | 62 | 55 | 50 | 39 | 36 | 32 | 50 |
| 2 | Vibration-Damping Sheet | 72 | 62 | 52 | 47 | 36 | 23 | 18 | 49 |
| 3 | Hardboard | 70 | 61 | 52 | 47 | 37 | 25 | 21 | 48 |

TABLE 2

Light Floor Impact Noise Level (dB)

| | Test Floor | Octave-band Center Frequency 63 | 125 | 250 | 500 | 1000 | 2000 | 4000 | L |
|---|---|---|---|---|---|---|---|---|---|
| 1 | Intermediate Plywood Laminate | 51 | 55 | 54 | 46 | 35 | 29 | 21 | 48 |
| 2 | Vibration-Damping Sheet | 50 | 55 | 52 | 45 | 31 | 20 | 15 | 46 |
| 3 | Hardboard | 51 | 54 | 52 | 46 | 33 | 22 | 17 | 46 |

Figure 10:
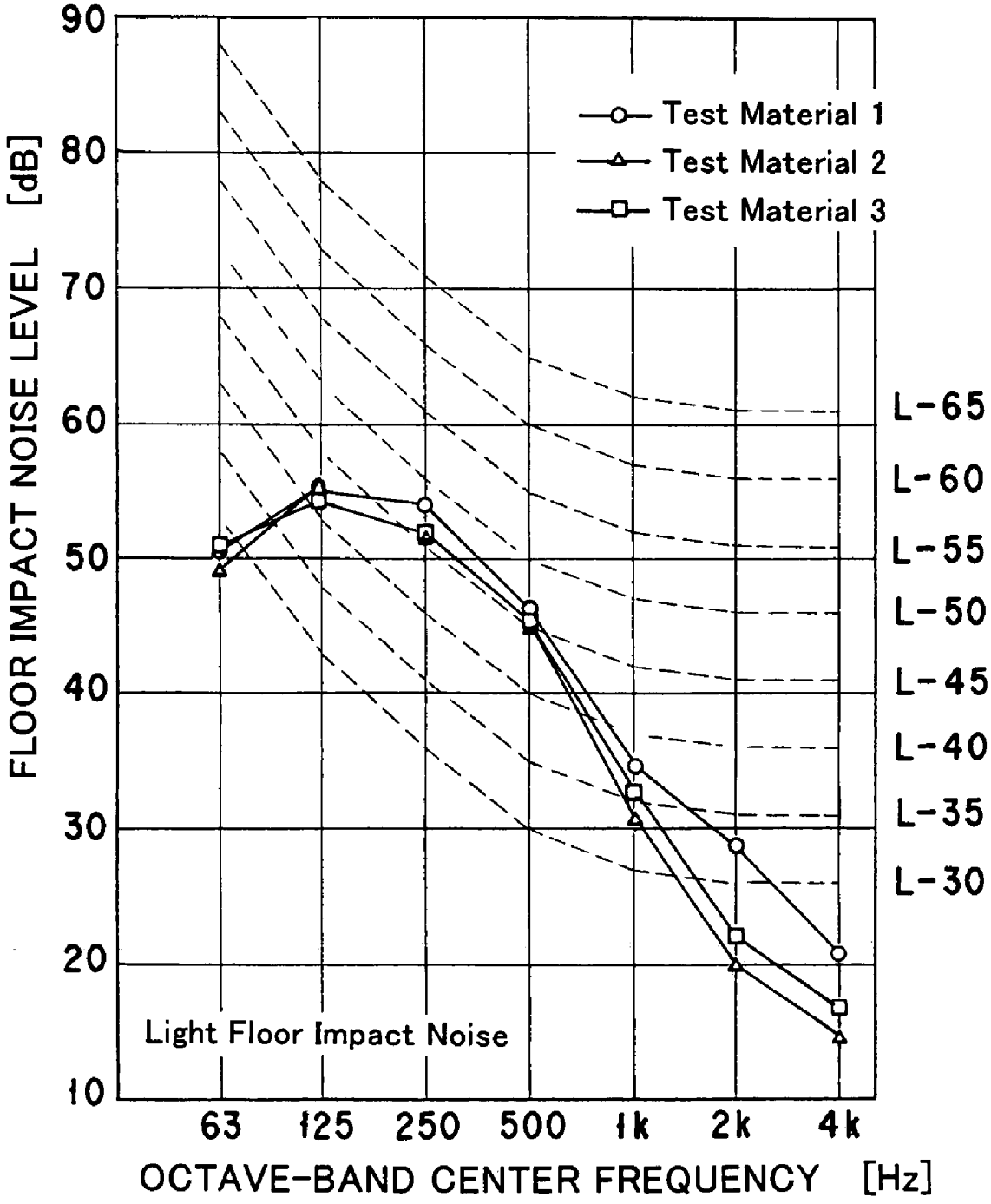
FIG. 10 is a graph showing the results of the light floor impact noise level measured in the experiment.

As being clear from the results shown in Tables 1 and 2 and FIGS. 9 and 10, the raised floor constructed by using the hardboards as an intermediate material had the floor impact noise insulating properties equivalent to or superior to those of the raised floor constructed by using the vibration-damping and sound-insulating sheet.

Although the preferred embodiments of the sound insulating floor structure of the present invention and the experiment that has been described above, the present invention is not limited to the above-mentioned embodiments and experiment applicable to various floor structures, and various modifications in design may be made. For example, although it is suitably applicable to the aforementioned structure in which the underlying floor panels are supported at their marginal portions by the unit supporting legs, it is also applicable to the floor structure constructed by using the underlying floor panel units each having the supporting legs attached to the edge parts of an underlying floor panel in such a manner that the height thereof may be adjustable. As to the unit supporting leg, besides the above-mentioned structure, various unit supporting legs may be used insofar as they have an elastic pedestal at the position contacting a foundation floor. For example, the unit supporting leg having a supporting bolt and a support member (underlying floor panel support member having an internal thread) to which the upper threaded portion of the supporting bolt is screwed, both being manufactured from a hard plastic may also be used. Moreover, an elastic pedestal having a center bore which is a through-hole may also be used. If a supporting bolt has treaded portions at both ends, the unit supporting leg having a flanged nut into which the lower threaded portion is screwed and which is fitted in a center bore of an elastic pedestal may also be used. Furthermore, it is also possible to form one or a plurality of slots in the treaded portion of the supporting bolt or in the internal thread of level adjusting nut in the axial direction thereof so that an adhesive agent may smoothly penetrate into their screwing parts. Furthermore, it is possible to form the adhesive agent flow portions on the support plate by forming a plurality of grooves on the surface thereof, preferably radiating in all directions so as to intercommunicate with an adhesive agent reservoir, so that an adhesive agent may smoothly flows to the gap between an underlying floor panel and a support plate. The described embodiments are therefore to be considered in all respects as illustrative and not restrictive, the scope of the invention being indicated by the appended claims rather than by the foregoing description and all changes which come within the meaning and the range of equivalency of the claims are, therefore, intended to be embraced therein.

What is claimed is:

1. A sound insulating floor structure, comprising an underlying floor layer of a raised floor constructed by supporting a plurality of underlying floor panels at a predetermined height by means of a group of supporting legs installed on a foundation floor via a plurality of elastic pedestals attached to lower ends of the supporting legs, wherein at least one of said plurality of elastic pedestals is made of rubber, floor covering materials laid over the underlying floor layer, and intermediate materials laid between the underlying floor layer and the floor covering materials, characterized in that said intermediate material is a hardboard or a high density fiberboard having the flexural strength of 35-50 [N/mm$^2$], Young's modulus in flexure of 4,000-5,000 [N/mm$^2$] and the density of 0.8-1.2 [g/cm$^3$].

2. The sound insulating floor structure according to claim 1, wherein said supporting leg is a unit supporting leg comprising said elastic pedestal made of rubber, a hollow supporting bolt rotatably disposed on said elastic pedestal in the erected state, and a support plate mounted on said hollow supporting bolt in such a manner that it is moved up and down to adjust the height thereof through the medium of a level adjusting nut screwed onto an upper end of said hollow supporting bolt, wherein said elastic pedestal has a bore portion for accommodating a lower end of the hollow supporting bolt, at least one groove formed in the underside thereof, and at least one hole intercommunicating said bore portion to said groove.

3. The sound insulating floor structure according to claim 2, wherein said hollow supporting bolt has a bulge portion enlarged in the lateral direction and formed in a predetermined position of a portion thereof to be inserted in the bore portion of the elastic pedestal, and the elastic pedestal has a concaved portion formed in an inside circumferential surface of the bore portion for accommodating the bulge portion of said hollow supporting bolt and at least one groove connected with said intercommunicating hole and formed so as to extend from a bottom surface of the bore portion to a side of the pedestal.

4. The sound insulating floor structure according to claim 2, wherein said elastic pedestal has at least three projections in the underside contacting with said foundation floor.

5. The sound insulating floor structure according to claim 2, wherein said support plate has an adhesive sheet attached to an upper surface thereof and an adhesive agent flow portion formed on the upper surface thereof.

6. The sound insulating floor structure according to claim 1, wherein each of said plurality of said elastic pedestals is made of rubber.

7. The sound insulting floor structure according to claim 6, wherein said elastic pedestal has at least three projections in the underside contacting with said foundation floor.

* * * * *